US005415393A

United States Patent [19]

Fitzsimmons et al.

[11] Patent Number: 5,415,393

[45] Date of Patent: May 16, 1995

[54] PORTABLE BASKETBALL GOAL WITH COLLAPSIBLE BASE

[75] Inventors: James N. Fitzsimmons, Waukesha; David A. Allen, Pewaukee, both of Wis.

[73] Assignee: Huffy Corporation, Miamisburg, Ohio

[21] Appl. No.: 69,554

[22] Filed: May 28, 1993

[51] Int. Cl.[6] ..... A63B 63/08; F16M 11/00

[52] U.S. Cl. ..... 273/1.5 R; 248/158; 248/528; 248/910

[58] Field of Search ..... 273/1.5 R, 1.5 A; 248/158, 159, 514, 528, 910

[56] References Cited

U.S. PATENT DOCUMENTS

| | | | |
|---|---|---|---|
| D. 264,740 | 6/1982 | Merino et al. | D21/201 |
| 3,137,502 | 6/1964 | Duganich | 273/1.5 R |
| 3,716,234 | 2/1973 | Lancellotti | 273/1.5 R |
| 3,841,631 | 10/1974 | Dolan | 273/1.5 R |
| 3,900,194 | 8/1975 | Ward et al. | 272/1 B |
| 4,145,044 | 3/1979 | Wilson et al. | 273/1.5 R |
| 4,412,679 | 11/1983 | Mahoney et al. | 273/1.5 R |
| 4,759,545 | 7/1988 | Grable | 273/1.5 R |
| 4,793,611 | 12/1988 | Thornell | 273/1.5 R |
| 4,869,501 | 9/1989 | Anastasakis | 273/1.5 R |
| 5,259,612 | 11/1993 | Matherne et al. | 273/1.5 R |

FOREIGN PATENT DOCUMENTS 2234942 2/1973 Germany .

*Primary Examiner*—William H. Grieb
*Attorney, Agent, or Firm*—Biebel & French

[57] ABSTRACT

A support assembly for supporting and orienting an elongated pole to extend at an angle to the vertical, wherein the support assembly includes a pole having spaced apart upper and lower ends, an intermediate point and a lower portion between the intermediate point and lower end. The support assembly also includes a base having a pivot axis, a point of pole engagement and an extension generally in the same direction as the angular extension of the pole when assembled on the base such that the pole and the base extension generally form two legs of an angle. The support assembly includes a support arm having spaced apart ends, wherein one of the ends engages the base in spaced relationship from the point of pole engagement on the base, and wherein an extension presents the other of the ends at the intermediate point on the pole when assembled so that the base extension, the support arm extension and the lower portion of the pole form a triangle. A connecting arrangement removably interconnects the one support arm end and the base for pivotal movement of the support arm about the base pivot axis between raised and lowered positions relative to the base. The connecting arrangement includes a first seat on the base and a second seat on the support arm generally complementary to and interacting with the first seat on the base to define the pivot axis upon which the support arm pivots relative to the base.

19 Claims, 6 Drawing Sheets

38
42
10
26
131
18
22
34
14
5
31
5
273
32
8
30
8
50
238
234
58
46

318
46
50
15
58
15
273
234
238

PORTABLE BASKETBALL GOAL WITH COLLAPSIBLE BASE

BACKGROUND OF THE INVENTION

This invention relates to basketball goal support assemblies and, more particularly, to such support assemblies as are portable.

Various types of basketball goal support assemblies have been proposed in the past. Such proposals have recognized that stability, and in some instances portability, are desirable characteristics. However, stability and portability can present conflicting design considerations and make it difficult to provide collapsibility.

On playgrounds and at pool sides, for example, a portable goal support assembly is desirable. In such applications, the ability to clear the support assembly from the area, or to arrange a particular play area in a different configuration, is a much sought-after attribute. This is even true to some degree in residential applications. Providing both stability and portability in a particular construction can also come at the price of requiring overall a more complex structural arrangement and larger base, which means added complexity in both assembly and use as well as increased costs.

One attempt at achieving portability and stability within a single support assembly has been to incorporate some form of ballast in the support base in order to keep the base smaller. These and other prior ballast arrangements, however, have generally proved to be unacceptable due to the lack of sufficient stability in the final product, too much complexity, or both.

SUMMARY OF THE INVENTION

While a larger base is desirable for stability, it is undesirable in terms of portability, storage, and shipment. Therefore, it is desirable to provide for collapsibility of the support base to further facilitate storage and shipment and thereby reduce the costs associated with storage and shipment.

Accordingly, it is among the general objects of this invention, then, is to provide a stable, portable support assembly for a basketball goal.

Another general object of this invention is to provide a simple and effective ballasted, portable, basketball goal support assembly that can be conveniently collapsed for storage.

A further general object of this invention is to provide a portable basketball goal support assembly which has an effective ballast arrangement for stability.

A still further general object of this invention is to provide such a support assembly for a basketball goal which additionally in operation is simple to relocate.

A still further object of this invention is to provide a support assembly for a basketball goal including a base assembly that is conveniently foldable for shipping and storage and that is easily assembled for use.

The invention provides a support assembly for supporting and orienting an elongated pole to extend at an angle to the vertical. The support assembly includes a pole having spaced apart upper and lower ends, an intermediate point and a lower portion between the intermediate point and lower end. The support assembly also includes a base having a pivot axis, a point of pole engagement and an extension generally in the same direction as the angular extension of the pole when assembled on the base so that the pole and the base extension generally form two legs of an angle. The support assembly further includes a support arm having spaced apart ends. One of the ends engages the base in spaced relationship from the point of pole engagement on the base. The support arm also includes an extension which presents the other of the ends at the intermediate point on the pole when assembled so that the base extension, the support arm extension and the lower portion of the pole form a triangle. A connecting means is provided to interconnect the one support arm end and the base for pivotal movement of the support arm about the base pivot axis between raised and lowered positions relative to the base. The connecting means includes a first seat on the base and a second seat on the support arm generally complementary to and interfacing with the first seat on the base to define the pivot axis upon which the support arm pivots relative to the base.

DESCRIPTION OF THE PREFERRED EMBODIMENT

Figures 1, 2:
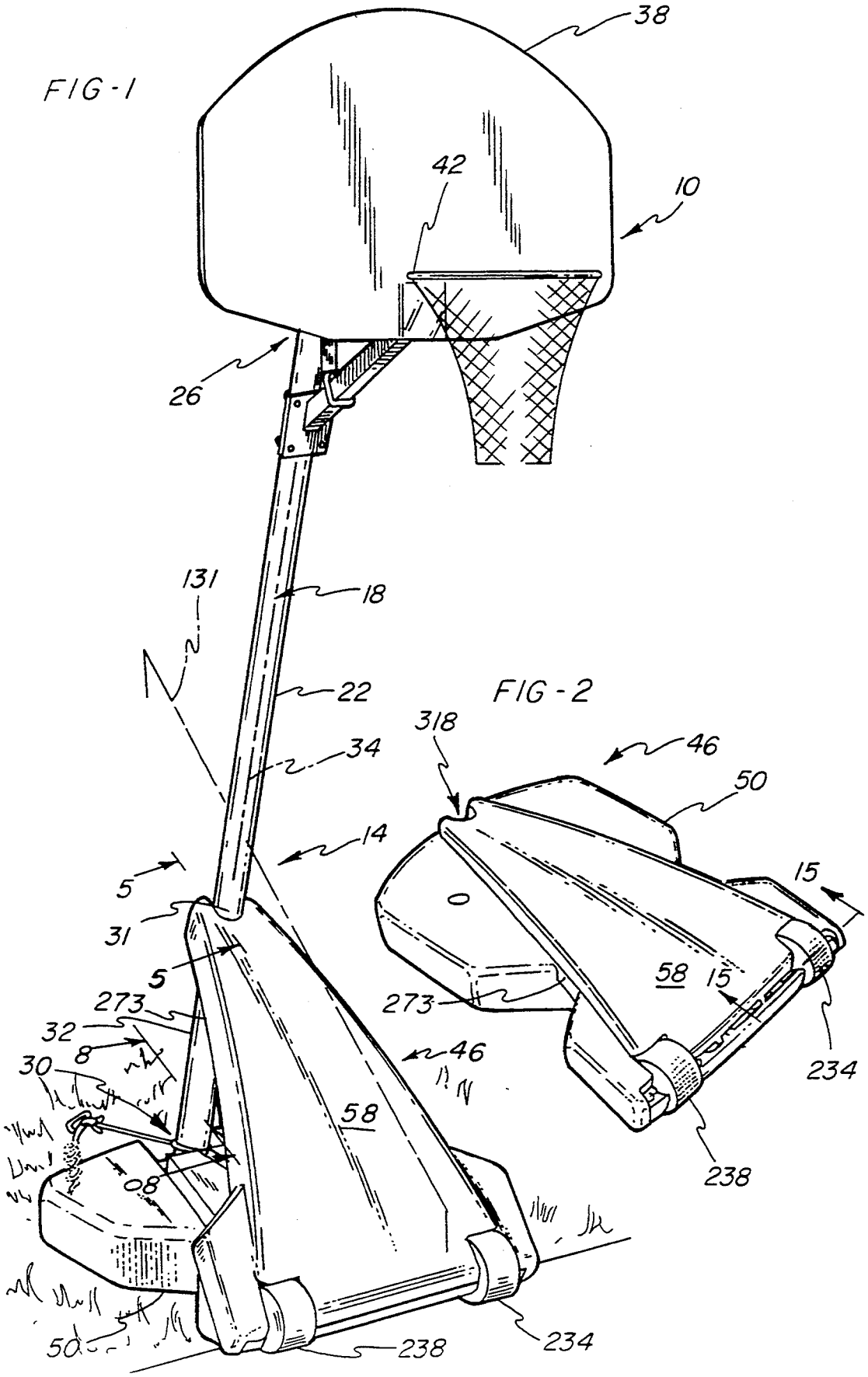
FIG. 1 is a perspective view of the portable basketball goal support system including a support assembly having a base and a support arm deployed to support a goal support pole.
FIG. 2 is a perspective view of the support assembly with the support arm folded onto the base for shipping and compact storage.
Figure 4:
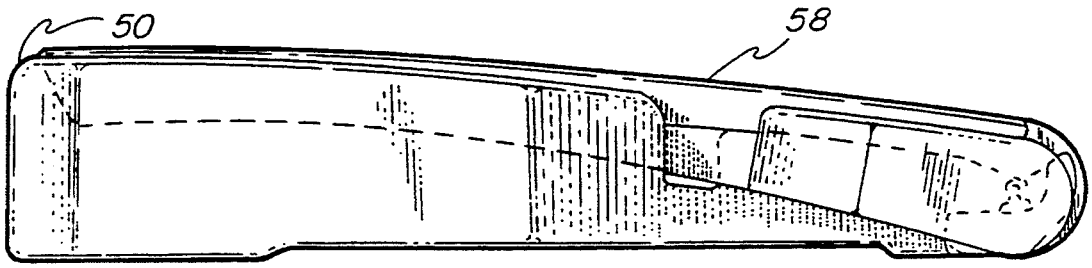
FIG. 4 is a side elevational view of the support assembly as shown in FIG. 2.

Shown in FIG. 1 of the drawings is a basketball goal 10 having a support system 14 for supporting the basketball goal 10 above a playing surface. The goal 10 includes a generally hollow support pole 18 having an outer surface 22, opposite upper and lower ends 26 and 30, an intermediate point 31, a lower portion 32, and a longitudinally extending pole axis 34 extending at an angle to vertical. A backboard 38 and rim 42 are mounted on the upper end 26 of the pole 18.

Figure 8:
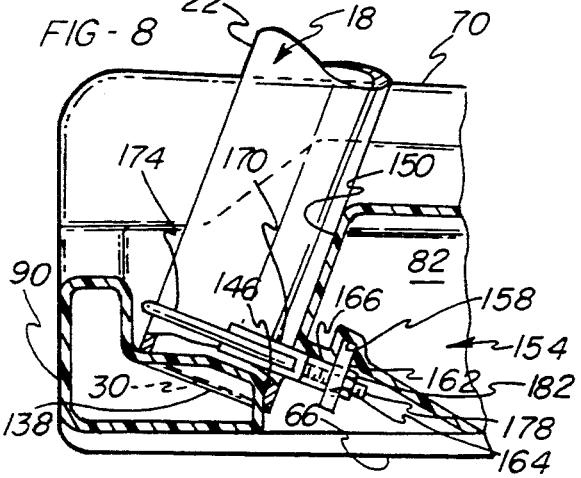
FIG. 8 is a partial cut-away view of the base taken along 8—8 showing the support pole mounted in the base.
Figure 9:
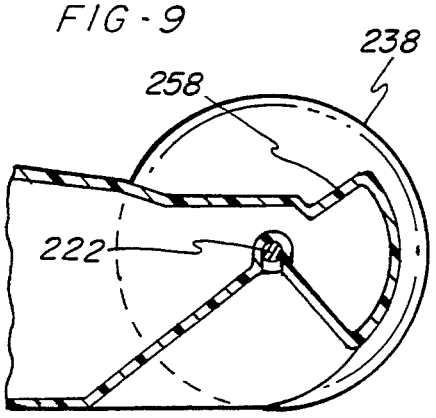
FIG. 9 is a cross-section taken along 9—9 in FIG. 6.

The support system 14 includes a support assembly 46 having a base 50 (best shown in FIG. 6) which includes an extension along a longitudinal axis 54. The support assembly 46 also includes a support arm 58 which is pivotally attached to the base 50. As shown in FIG. 8, the lower end 30 of the pole 18 is connected to the base 50 and the pole 18 is supported by the support arm 58 as will be described below.

Referring generally to FIGS. 6–9, the base 50 includes a generally planar, horizontal bottom portion 62 having an extension in the direction of the angle of the pole 18, and a lower surface 66 which is adapted to rest on a playing surface or supporting surface. The base 50 also includes a top portion 70 defining an upper surface 74. The top portion 70 is substantially parallel to the bottom portion 62. A continuous side portion 78 connects the bottom portion 62 to the top portion 70. Together, the top portion 70, bottom portion 62 and side portion 78 form a water chamber 82 in the base 50. The upper surface 74 includes an opening defining a water inlet 86 that communicates with the water chamber 82. The base 50 can be filled with water to provide stability to the support system 14 during use of the basketball goal 10.

The side portion 78 includes a rearward surface 90 (FIG. 7) having opposite side ends 94 and 98. The rearward surface 90 is substantially perpendicular to the longitudinal axis 54. The side portion 78 also includes first and second side surfaces 102 and 106 which extend in the direction of arrow 1 in FIG. 6 forwardly from the respective opposite side ends 94 and 98 of the rearward surface 90 and are generally parallel to the longitudinal axis 54 of the base 50.

The continuous side portion 78 also includes first and second inwardly extending surfaces 110 and 114 which are respectively connected to the first and second side surfaces 102 and 106 and which narrow inwardly toward the longitudinal axis 54 of the base 50. A pair of outwardly extending surfaces 118 and 122 are respectively connected to the inwardly extending surfaces 110 and 114 and extend outwardly from the longitudinal axis 54 of the base 50. Third and fourth side surfaces 126 and 130 are respectively connected to the outwardly extending side surfaces 118 and 122 and are connected to a front surface 134 which extends between the third and fourth side surfaces 126 and 130.

A vertical plane 131 (see FIGS. 1 and 15) which extends through pole axis 34 and the longitudinal axis 54 of the base 50 divides the base into two halves which, except for the water inlet 86, are substantially symmetrical. The base 50 includes an opening 138 defining a point of pole engagement or pole mount, which is defined by the top portion 70, bottom portion 62, and the rearward surface 90 of the side portion 78. The opening 138 extends between the upper surface 74 and the lower surface 66 and is aligned with the base axis 54. The opening 138 includes a canted resting shelf 142 which supports the lower end 30 of the support pole 18 so that the pole 18 extends at an angle relative to the horizontal. The resting shelf 142 includes a protrusion or pilot portion 146, which is generally circular. The pilot portion 146 extends upwardly into the generally hollow support pole 18 to fix the lower end 30 of the support pole 18 relative to the base 50.

The base 50 includes a support pole engaging surface 150 which extends generally perpendicular to the resting shelf 142 and which engages the outer surface 22 of the support pole 18 to secure the support pole 18 at a selected angle. Thus, the surface 150 is parallel to the pole axis 34.

The base 50 also includes a first saddle clamp assembly 154. As shown in FIG. 8, the first saddle clamp assembly 154 includes a downwardly opening notch or first saddle clamp seat 158 which is defined by the bottom portion 62, and which is adjacent the opening 138. The first saddle clamp seat 158 is perpendicular to the longitudinal axis 54 of the base 50. A bracket 162 including a pair of bores 164 (only one of which is shown) is mounted in the seat 158. A spacer 166 and saddle clamp 170 are connected to the bracket 162 so that the saddle clamp 170 opens rearwardly to engage the outer surface 22 of the lower end 30 of the pole 18. The saddle clamp 170 includes a pair of saddle clamp bores (not shown) that are aligned with the respective bores 164 on the bracket 162.

The first saddle clamp assembly 154 also includes a U-clamp 174. The U-clamp 174, as is known in the art, includes a pair of threaded ends 178 (only one of which is shown). The U-clamp 174 surrounds the pole 18 so that the ends 178 extend through the bores in the saddle clamp 170, the spacer 166, and the bores in bracket 162. A pair of nuts 182 (only one of which is shown) are respectively threaded onto the ends of the U-clamp 174 to secure the saddle clamp assembly 154 to the pole 18 and to the base 50 and secure the lower end 30 of the support pole 18.

Figure 6:
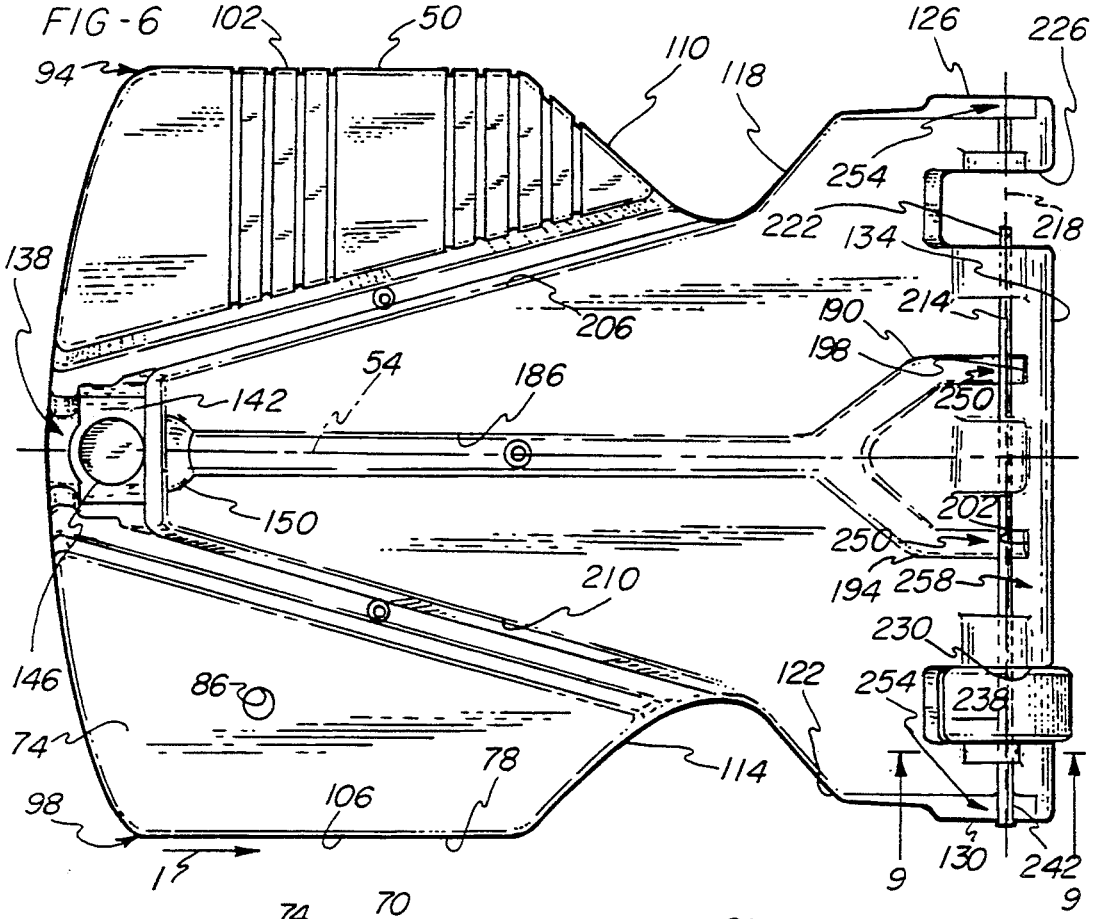
FIG. 6 is a top plan view of the base.
Figure 7:
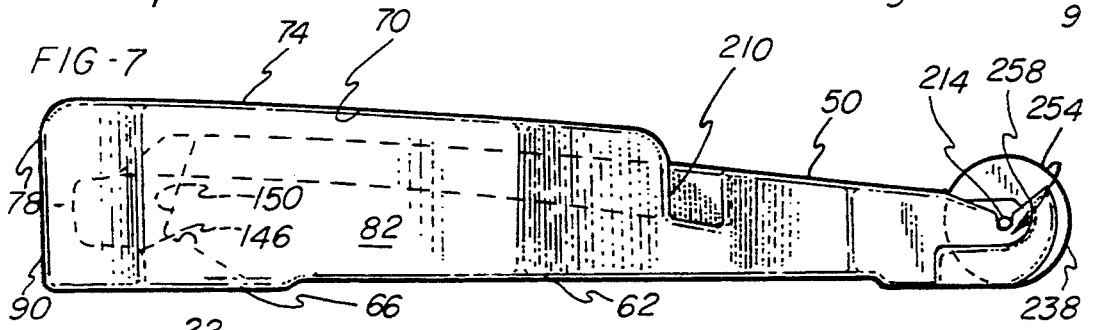
FIG. 7 is a side elevational view of the base.

As shown in FIG. 6, the upper surface 74 includes a center groove 186 which extends forward from the opening 138 and along the longitudinal axis 54. The groove splits, near the front surface 134, into two recesses 190 and 194 which diverge from the base axis 54 and each respectively terminates at a pair of ends 198 and 202 which are short of the front surface 134. Two side grooves 206 and 210 also extend generally radially forward from the opening 138 on opposite sides of the center groove 186. In the preferred form of the invention, the side grooves 206 and 210 constantly linearly diverge from the center groove 186 as they extend from the rearward surface 90 toward the front surface 134.

The base 50 also includes an open ended channel or first seat 214 which extends generally parallel to the front surface 134 and which defines a pivot axis 218. An axle 222, which is part of a connecting means for connecting support arm 58 to base 50, lies in the channel and is coextensive with the pivot axis 218 through the width of the base 50. As best shown in FIG. 6, the front surface 134 includes a pair of stepped portions defining a pair of wheel wells 226 and 230. A pair of wheels 234,238 (wheel 234 appears only in FIGS. 1 and 2) are mounted on the axle 222 within the wheel wells 226 and 230. The wheels 234 and 238 project beyond the front surface 134 so that they solely support the basketball goal support system 14 when the rearward surface 90 is elevated. Thus, the entire support system 14 can be moved by elevating the rearward surface 90 of the base 50 so that only the wheels 234 and 238 of the support system 14 engage the support surface. In this position, the entire unit is easily movable for storage or other purposes.

Figure 10:
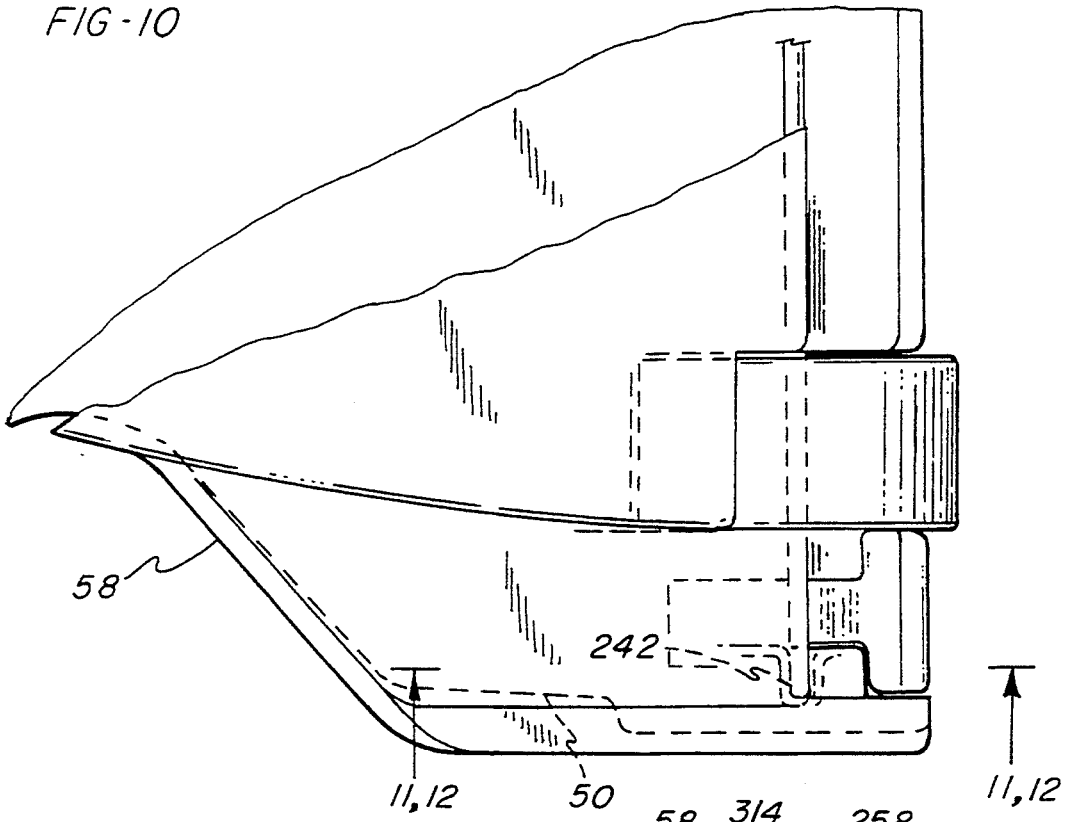
FIG. 10 is a partial top view of the base with portions cut-away.
Figure 11:
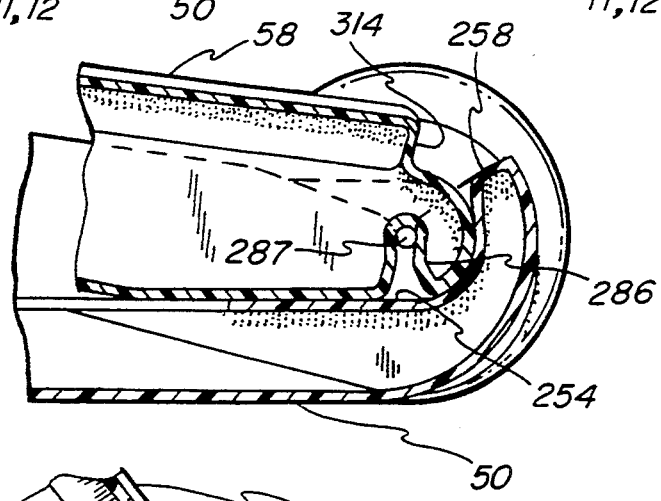
FIG. 11 is a partial cross-section taken along 11—11 in FIG. 10 showing the support arm on the base in the folded position.
Figure 12:
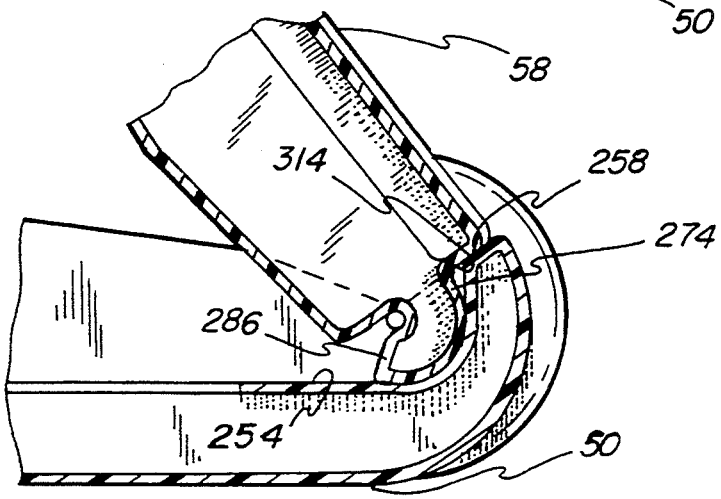
FIG. 12 is a partial cross-section taken along 12—12 in FIG. 10 showing the support arm in the deployed position.
Figure 15:
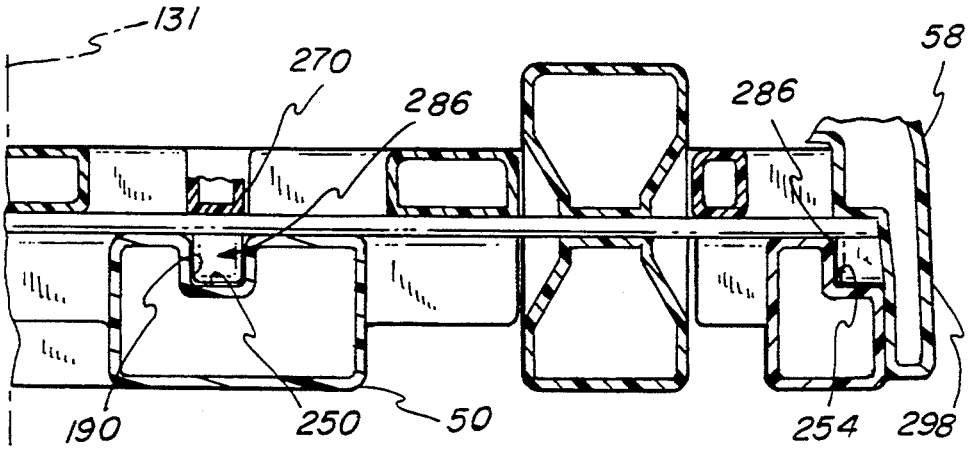
FIG. 15 is a partial cross-section taken along 15—15 in FIG. 2.

As shown in FIG. 6, the axle 222 is exposed to the upper surface 74 of the base 50 in four locations, two of which correspond to the recesses 190 and 194, and two of which are adjacent the ends 242 (only one of which is shown in FIGS. 6 and 10) of the axle 222. FIGS. 6 and 15 illustrate that the axle 222 is orientated in the recesses to define spaces 250 around the axle 222. As shown in FIGS. 11 and 12, the base 50 also defines spaces 254 (only one of which is shown in FIGS. 11 and 12) around the axle 222 at the ends 242 and 246.

The base 50 includes a stop 258 disposed between the front surface 134 and the first seat 214. The stop 258 and the axle 222 interact with the support arm 58 in a manner described below to axially secure the axle 222 relative to the base 50 and to secure the support arm 58 relative to the base 50 when the unit is assembled for use.

As previously mentioned, the support system 14 also includes the generally planar support arm 58. The support arm 58 is pivotal between a first folded position (shown in FIG. 2) wherein the support arm 58 nests on the base 50 and a second deployed position (shown in FIG. 1) wherein the support arm 58 provides support to the pole 18.

Referring generally to FIGS. 1, 10–15, the support arm 58 is divided into symmetrical halves by the vertical plane 131 which extends through the longitudinal axis 54 of the base 50. The support arm 58 includes a first lower surface 262 and a second upper surface 266. The lower surface 262 faces the upper surface 74 of the base 50. The support arm 58 includes a center rib or projection 268 depending from the lower surface 262. The center rib 268 lies in the vertical plane 131. When the support arm 58 is in the folded position (FIG. 2), the center rib 268 is nested within the center groove 186 of the base 50. The center rib splits into two prongs 270 and 271 which fit within the respective recesses 190 and 194 when the support arm 58 is in the folded position.

The support arm 58 also includes two side-walls or projections 272 and 273 also depending from the lower surface 262. The side-walls 272 and 273 are located on opposite sides of the center rib 268. The side-walls 272 and 273 extend transverse relative to the vertical plane and are designed to nest within the respective transverse side grooves 206 and 210 formed in the upper surface 74 of the base 50 when the support arm 58 is in the folded position of FIG. 2. The center rib 268 and projections 272 and 273 provide rigidity to the support arm 58.

The support arm 58 includes a front edge 274. The front edge 274 has a pair of stepped portions 278 and 282 oppositely disposed relative to the vertical longitudinal plane 131. The stepped portions 278 and 282 define wheel wells which are aligned with the wheel wells 226 and 230 on the base 50 and which are substantially complementary with and partially house the wheels 234 and 238 mounted on the base 50.

The edge 274 also defines four hook-like projections 286 (FIGS. 11, 13 and 14) which extend forward from the edge and which have a second seat 287 engaging the axle 222. Projection 286 also form part of the connecting means for releasably connecting the support arm 58 to base 50. The hook-like projections 286 are positioned to freely drop vertically in a complementary fashion, into the four previously described spaces 250 and 254 formed in the base 50 when support arm 58 is parallel to base 50. Subsequent pivotal movement of the support arm 58 to its pole support position (see FIG. 12) causes the hook-like projections 286 to wrap around under the axle 222 thereby locking the support arm 58 onto the axle 222.

The support arm 58 also includes a pair of side portions 290 and 294 respectively located on opposite sides of the vertical plane 131. The side portions 290 and 294 each define a skirt 298 and 302. The skirts depend from the support arm 58, respectively cover the ends of the channel 214, and prevent axial movement of the axle 222 relative to the base 50. The lower surface 262 includes an abutment 314 (see FIG. 11 and 12) adjacent the front edge 274 which, when the support arm 58 is in the support position of FIG. 1, abuts the stop 258 of the base 50 and provides a positive stop against over rotation of the support arm 58 about the axle 222.

Figure 5:
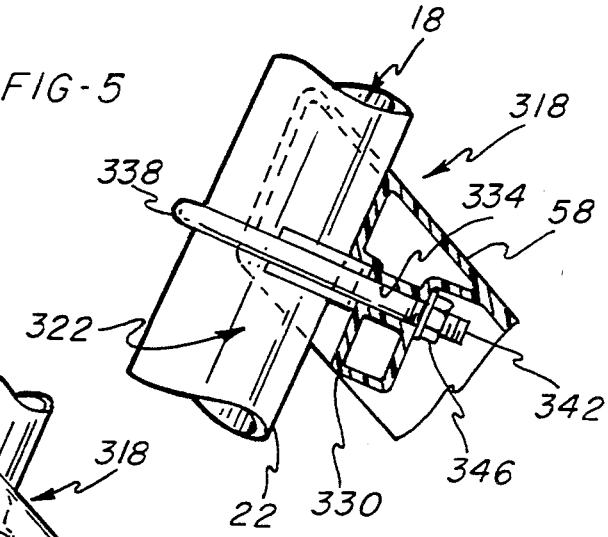
FIG. 5 is a cross-section taken along 5—5 in FIG. 1.
Figure 3:
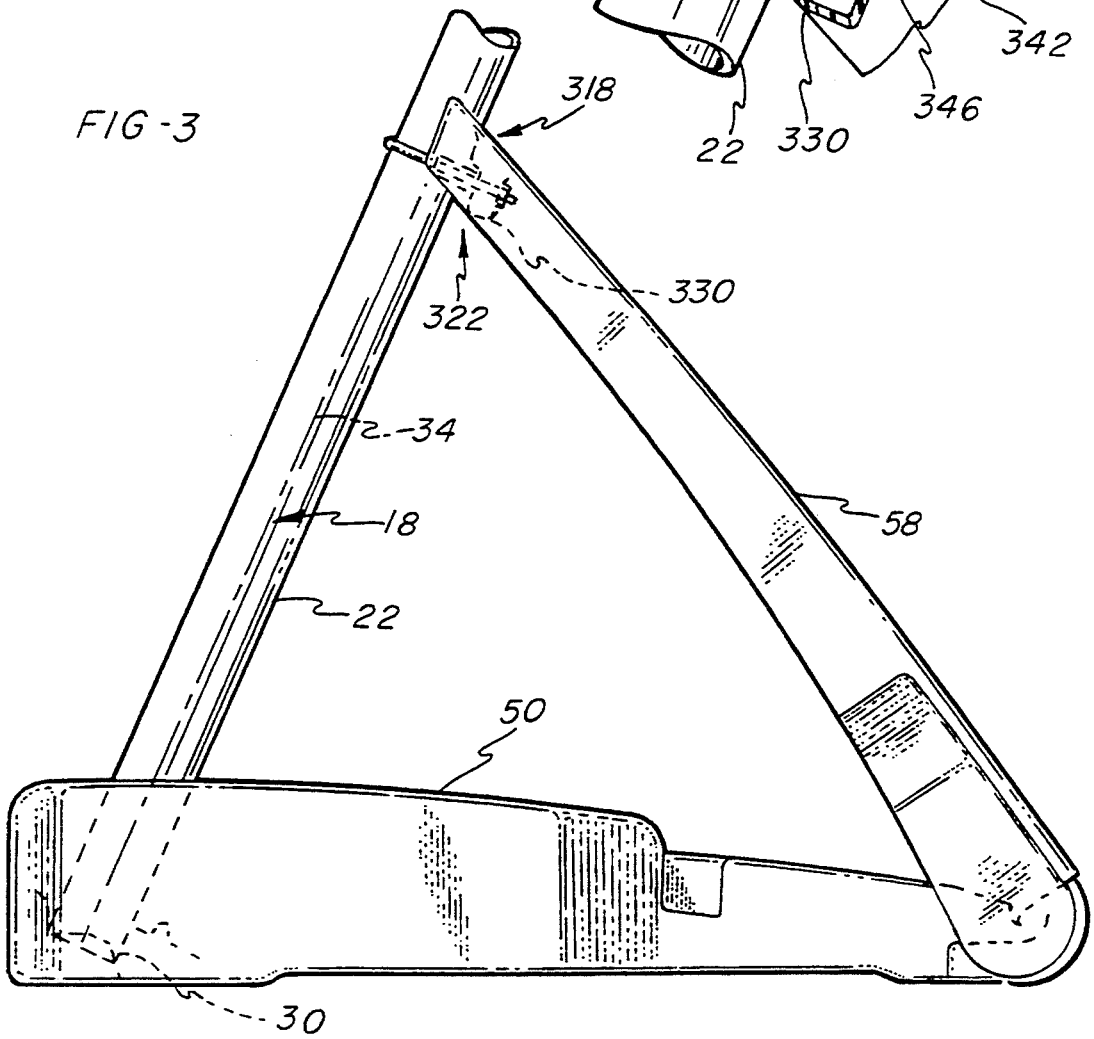
FIG. 3 is a side elevational view of the support assembly as shown in FIG. 1.
Figure 13:
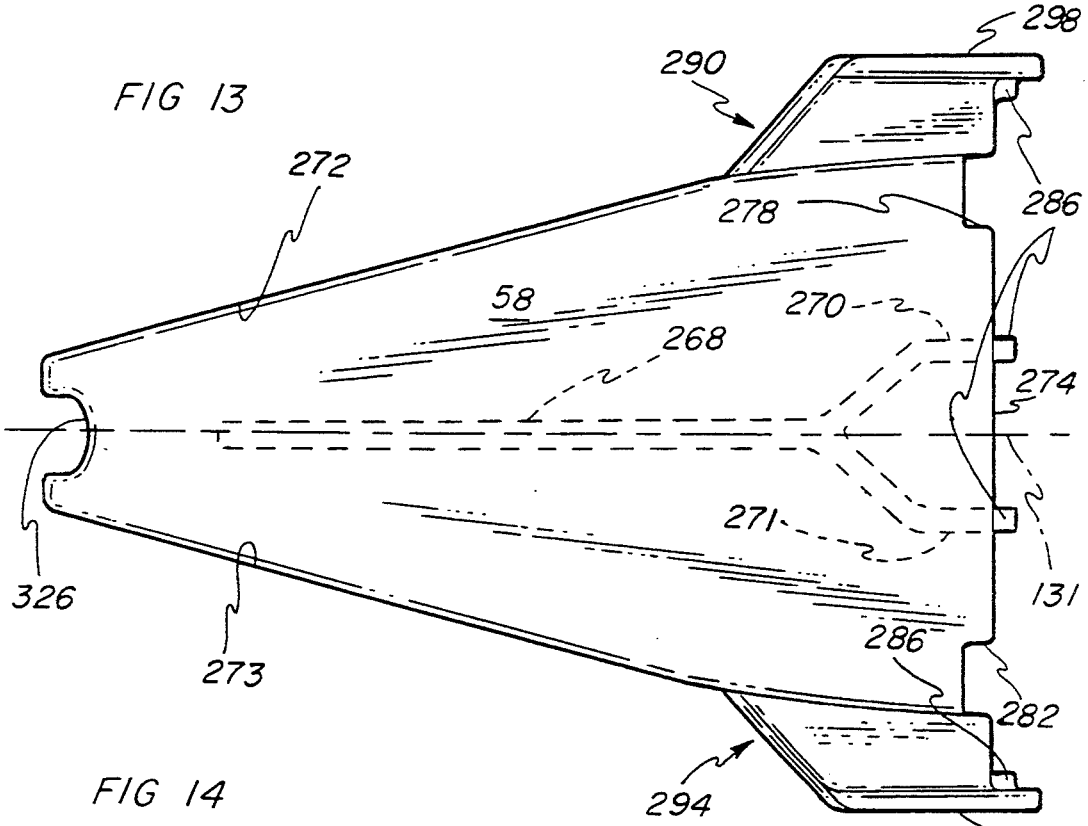
FIG. 13 is a top plan view of the support arm.
Figure 14:
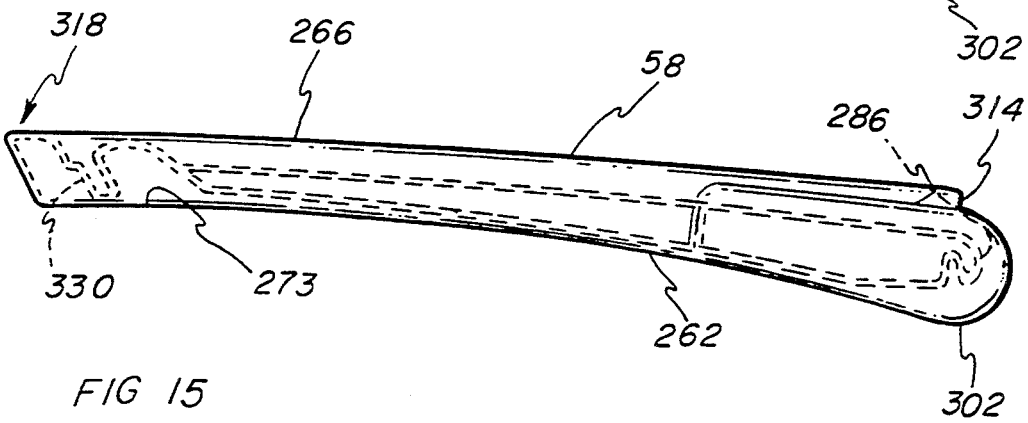
FIG. 14 is a side elevational view of the support

As shown in FIGS. 3, 5 and 13, the support arm 58 also includes a rearward end 318 which has therein a second saddle clamp assembly 322 having a saddle-shaped recess 326 adapted to receive the support pole 18. As shown best in FIG. 5, the second saddle clamp assembly 322 also includes a downwardly extending stub member 330 having therein a pair of bores 334 (only one of which is shown). A U-clamp 338 which includes a pair of threaded ends 342 (only one of which is shown) extends around the support pole 18. The threaded ends 342 are respectively received into the bores 334 on the stub member 330. Nuts 346 (only one shown) are threaded onto the threaded ends 342 of the U-clamp 338 to secure the U-clamp into place on the support arm 58 and fix the support pole 18 relative to the support arm 58.

In operation, the basketball support system 14 is shipped with the base 50 and support arm 58 in the folded position with the axle 222 and wheels already mounted in the base 50. The basketball goal support system 14 is assembled by pivoting the support arm 58 to the position shown in FIGS. 1 and 3 and inserting the pole 18 into the opening 138 in the base 50 and into the saddle-shaped opening in the support arm 58. The pole 18 is then secured relative to the base 50 by first saddle clamp assembly 154 as shown in FIG. 8 and relative to the support arm 58 by second saddle clamp assembly 322 as shown in FIG. 5. Water can then be added to the base 50 through the water inlet 86 in order to provide ballast to the basketball goal support system 14.

If it is desired or necessary to move the portable basketball goal support system 14, the rear portion 90 of base 50 can be lifted to pivot it about the axis of the axle 222 so that the bottom surface is no longer in contact with the playing surface. In this position, the support assembly 46 is supported solely by the wheels and the entire basketball goal 10 and support system 14 can be easily maneuvered to any desired location.

Figure 16:
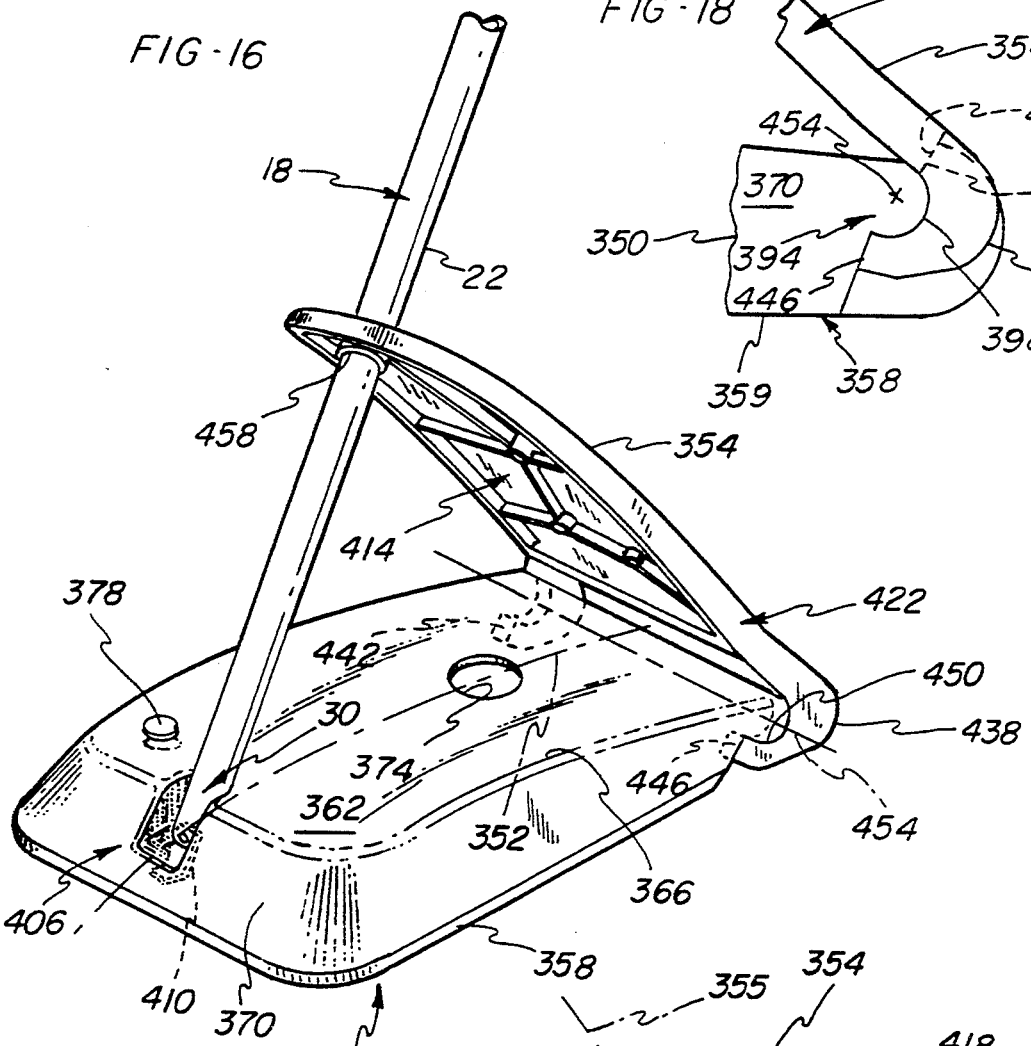
FIG. 16 is a perspective view of an alternative embodiment of the basketball goal support system.
Figure 18:
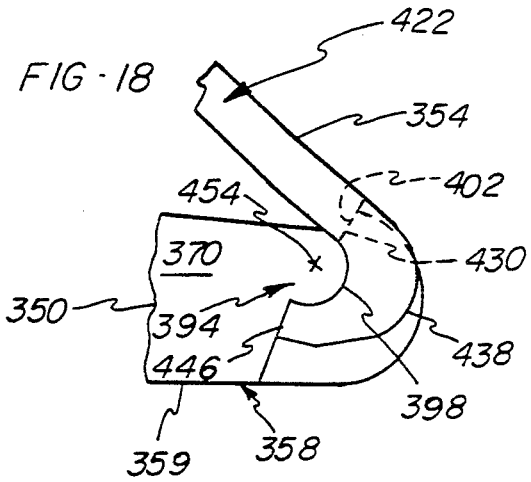
FIG. 18 is a partial side elevational view of the support system shown in FIG. 16.
Figure 17:
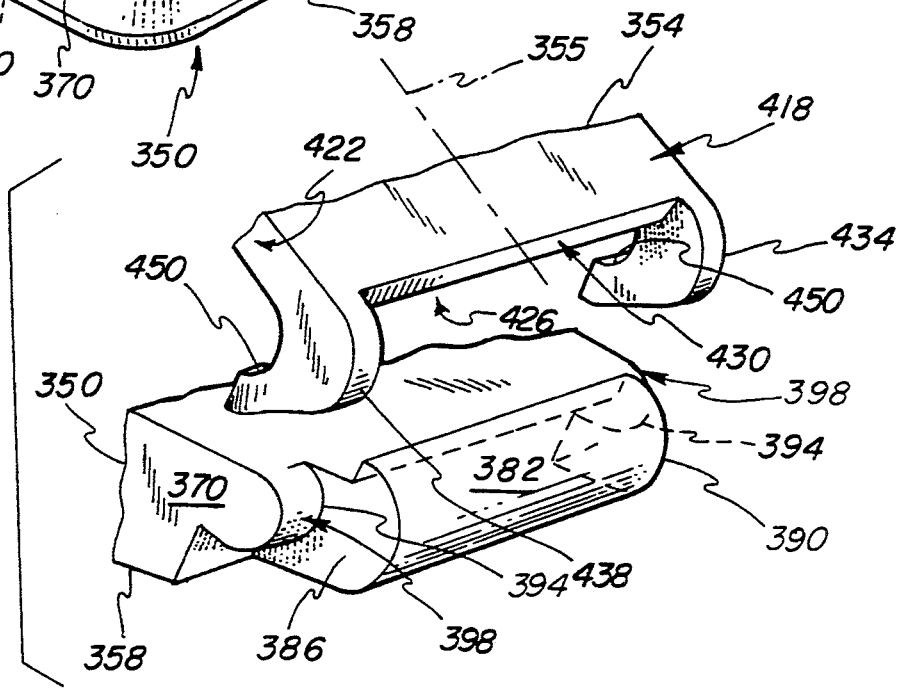
FIG. 17 is a partial, exploded view of the support system shown in FIG. 16.

FIGS. 16–18 show an alternative embodiment of the basketball goal support system. Identical parts are identified using like reference numerals. The support system includes a base 350 having a longitudinal axis 352 and a support pole 18 adapted to be connected at its lower end 30 to the base. A support arm 354 is pivotally connected to the base 350 by a retaining means which will be described in greater detail below. The support arm 354 is connected for movement between folded and support positions, and when in the support position, is adapted to be connected to the support pole 18 so as to support the pole 18 and the basketball goal 10 mounted thereon, preferably at an angle.

The base 350 includes a generally planar, horizontal bottom portion 358 having a bottom surface 359 (See FIG. 18) which is adapted to rest on a playing surface or supporting surface. The base 350 also includes a top portion 362 defining an upper surface 366. The top portion 362 is substantially parallel to the bottom portion 358. A continuous side portion 370 connects the top portion 362 to the bottom portion 358.

Together, the top portion 362, bottom portion 358, and side portion 370 form a water chamber 374 in the base 350. Preferably, the upper surface 366 includes an opening therein defining a water nozzle 378 communicating with the water chamber 374. In this form, the base 350 can be filled with water to provide stability to the support system 14 during use of the basketball goal 10.

The continuous side portion 370 includes a front surface 382. The front surface 382 includes a pair of oppositely disposed stepped portions 386 and 390. Each stepped portion includes an arcuate member 394 forming a first seat 398 for the retaining means. In the alternative embodiment, the arcuate member 394 is integral with the base 350 but could be formed separately and secured to the base.

The retaining means also preferably includes a rearwardly facing stop portion 402 adjacent the front surface 382 of the base 350. The stop portion 402 extends parallel to the front surface 382 between the stepped portions 386 and 390.

The base 350 also includes an opening or pole mount 406 adjacent the rearward end of the base 350. The lower end 30 of the pole 18 extends into the opening 406 and is connected to the base 350. The particular details of the connection between the pole 18 and the base 350 form no part of the invention and will not be described in detail. Preferably, as shown in FIG. 16, a bracket 410 is bolted to the base 350 and to the pole 18 to secure the base 350 and pole 18 together.

The support arm 354 is preferably divided into symmetrical halves by a vertical plane 355 which extends through the longitudinal axis 352 of the base 350. The support arm 354 includes a first, lower surface 414 (FIG. 16) and a second, upper surface 418 (FIG. 17). The lower surface 414 faces the upper surface 366 of the base 350. A continuous side edge 422 connects the upper and lower surfaces 418 and 414.

The continuous side edge 422 includes a front portion 426 defining an abutment portion 430 which functions as part of the retaining means. The abutment portion 430 faces forwardly and, when the support arm 354 is pivoted to the support position, the abutment portion 430 engages the stop portion 402 of the base 350 (FIG. 18).

The support arm 354 also includes a pair of oppositely disposed engaging hooks 434 and 438. The hooks 434 and 438 terminate at respective end portions 442 and 446 which may engage the base 350 in a suitable manner to further prevent over-rotation of the support arm 354 relative to the base. The hooks define a second seat 450 which is generally complementary to and interfaces with the first seat 398 on the base 350. The first and second seats 398 and 450 pivot relative to one another to define a pivot axis 454 upon which the support arm 354 may pivot relative to the base 350.

Thus, when the support arm 354 is deployed to support the basketball goal 10, the first and second seats 398 and 450, abutment portion 430, stop portion 402, end portions 442 and 446, and base 350 cooperate and interact to prevent the removal of the support arm 354 from the base 350 but allow easy removal of the support arm 354 from the base 350 when the support arm is in the folded position.

The support arm 354 also includes a circular opening 458 adjacent the rearward edge of the support arm 354. The opening 458 is dimensioned to receive the basketball goal support pole 18. When the support arm 354 is deployed, i.e., in the support position, the pole 18 extends through the opening 458 and into the pole mount in the base 350 where it is secured to the base as described above.

From the foregoing description, one skilled in the art can make various changes and modifications to adapt the invention to various usages and conditions without departing from the spirit and scope of the invention.

We claim:

1. A support assembly for supporting and orienting an elongated pole to extend at an angle to the vertical, said support assembly comprising:

a pole having spaced apart upper and lower ends, an intermediate point and a lower portion between said intermediate point and lower end, a base having a pivot axis, a point of pole engagement and a base extension generally in the same direction as the angular extension of said pole when assembled on said base such that said pole and said base extension generally form two legs of an angle, a support arm having spaced apart ends, one of said ends engaging said base in spaced relationship from said point of pole engagement on said base, and a support arm extension presenting the other of said ends at said intermediate point on said pole when assembled so that said base extension, said support arm extension and said lower portion of said pole form a triangle, and connecting means interconnecting said one support arm end and said base for pivotal movement of said support arm about said pivot axis between raised and lowered positions relative to said base, said connecting means including a first seat on said base and a second seat on said support arm generally complementary to and interacting with said first seat on said base to define said pivot axis upon which said support arm pivots relative to said base wherein said base has an upper surface and said support arm is generally planar having a surface in overlaying relation to said base when in said lowered position, and said support arm in said lowered position fits in an area of said upper surface of said base to facilitate storage.

2. The support assembly according to claim 1 wherein said base has a lower surface, said upper surface being spaced from said lower surface, and a groove means in said upper surface of said base defining generally U-shaped spaced apart grooves extending generally in the direction of said base extension and opening upwardly through said upper surface of said base, said support arm has a first surface facing downward toward said upper surface of said base and a second surface which faces in an opposite direction to said first surface, and projection means on said first surface of said support arm defining spaced apart projections extending laterally downward from said first surface toward said base and relatively spaced to align with said U-shaped grooves in said base, said projections being configured to generally nest in said grooves when said support arm is in said lowered position.

3. The support assembly according to claim 2 wherein said base is hollow and said U-shaped grooves project into the said hollow interior of the base.

4. The support assembly according to claim 2 wherein said base has a front portion spaced from said point of pole engagement in the direction of said base extension, said first seat is on said front portion, and said grooves extend generally radially from said point of pole engagement toward said front portion.

5. The support assembly according to claim 4 wherein said pivot axis comprises an axle mounted in said first and second seats and a wheel means is mounted on said axle at said front portion of said base.

6. The support assembly according to claim 5 wherein said wheel means are positioned to project beyond said front portion for substantially supporting engagement with the surface on which said base is placed only when an end of said base remote from said wheels is elevated.

7. The support assembly according to claim 1 wherein said connecting means includes an open ended channel on said base having an inner end and said first seat is on said channel inner end.

8. The support assembly according to claim 1 wherein said first seat of said connecting means includes a first arcuate surface on said base remote from said point of pole engagement and said second seat includes a second arcuate surface on said support arm complimentary to said first arcuate surface.

9. The support assembly according to claim 1 wherein said support arm is freely removable from said base when in said lowered overlying position, and a retaining means is provided for automatically locking said support arm against removal from said base when said support arm is in said raised position.

10. The support assembly according to claim 9 wherein said retaining means includes a stop on said base and abutment on said support arm engageable with said stop when said support arm is in said raised position to prevent removal of said support arm from said base.

11. A support assembly for supporting and orienting an elongated pole to extend at an angle to the vertical, said support assembly comprising:

a pole having spaced apart upper and lower ends, an intermediate point and a lower portion between said intermediate point and lower ends, a base having a pivot axis, a point of pole engagement and a base extension generally in the same direction as the angular extension of said pole when assembled on said base such that said pole and said base extension generally form two legs of an angle, a support arm having spaced apart ends, one of said ends engaging said base in spaced relationship from said point of pole engagement on said base, and a support arm extension presenting the other of said ends at said intermediate point on said pole when assembled so that said base extension, said support arm extension and said lower portion of said pole form a triangle, and connecting means interconnecting said one support arm end and said base for pivotal movement of said support arm about said pivot axis between raised and lowered positions relative to said base, said connecting means including a first seat on said base and a second seat on said support arm generally complementary to and interacting with said first seat on said base to define said pivot axis upon which said support arm pivots relative to said base, wherein said point of pole engagement of said base includes a pilot portion insertable into said pole lower end, a first saddle clamp seat laterally offset from said pilot portion and a first saddle clamp mounted in said first saddle clamp seat for securing said lower pole end to said base.

12. The support assembly according to claim 1 wherein said other end of said support arm includes a second saddle clamp seat and a second saddle clamp mounted in said second saddle clamp seat for securing said support arm to said intermediate point of said pole.

13. A storable support assembly for a basketball backboard support pole comprising;

a base including a pole mount, and a pivot member resenting a pivot axis spaced from said pole mount;

a support arm mounted on said base for rotation relative to said pivot axis for a movement, between a lowered stored position overlaying said base and a raised pole supporting position;

a retaining means for retaining said support arm to said base;

said base having spaced apart grooves;

said support arm having spaced apart projections oriented to face toward and align with said grooves in said base, and said supporting projections being configured to nest within said grooves in said base when said support arm is in said lowered stored position.

14. A storable support assembly for a basketball backboard support pole comprising:

a base having an upper surface and including a pole mount and a pivot member presenting a pivot axis spaced from said pole mount;

a support arm mounted on said base for rotation relative to said pivot axis for a movement between a lowered stored position overlaying said base and a raised pole supporting position; and a retaining means for locking said support arm to said base when said support arm is moved to said raised pole supporting position.

wherein said support arm in said lowered stored position fits in an area of said upper surface of said base to facilitate storage.

15. The storable support assembly according to claim 14 wherein said retaining means is automatically engaged when said support arm is moved to said raised pole supporting position.

16. The storable support assembly according to claim 15 wherein said retainer means includes a stop on said base and an abutment on said support arm engageable with said stop when said support arm is in said raised pole supporting position to lock said support arm onto said base.

17. The storable support assembly according to claim 14 wherein said base includes a front portion remote from said pole mount and a first seat adjacent said front portion, said support arm includes a second seat generally complementary to and positioned to interface with said first seat on said base to define said pivot axis, and said pivot member is mounted in said first and second seats.

18. The storable support assembly according to claim 17 wherein said first seat comprises an open channel in said base, said pivot member comprises an axle mounted in said open channel, said base includes a recess underlying at least a portion of said channel and axle, and said second seat includes a hook on said support arm overlaying said axle and received within said recess in said base.

19. The storable support assembly according to claim 14 wherein said base has a front portion spaced from said pole mount, and a wheel means is mounted on said front portion.

* * * * *